US007407453B2

(12) United States Patent
Shannon

(10) Patent No.: US 7,407,453 B2
(45) Date of Patent: Aug. 5, 2008

(54) SELF-STORING BASKETBALL GOAL SYSTEM

(76) Inventor: Christopher J. Shannon, One Melody La., Kings Park, NY (US) 11754

( * ) Notice: Subject to any disclaimer, the term of this patent is extended or adjusted under 35 U.S.C. 154(b) by 257 days.

(21) Appl. No.: 11/352,599

(22) Filed: Feb. 13, 2006

(65) Prior Publication Data

US 2007/0191149 A1 Aug. 16, 2007

(51) Int. Cl.
*A63B 63/08* (2006.01)

(52) U.S. Cl. ..... 473/483; 473/479

(58) Field of Classification Search ..... 473/483, 473/479, 481, 472, 485, 480
See application file for complete search history.

(56) References Cited

U.S. PATENT DOCUMENTS

| | | | | | |
|---|---|---|---|---|---|
| 3,018,102 | A | * | 1/1962 | Murphy | 473/481 |
| 3,716,234 | A | * | 2/1973 | Lancellotti | 473/481 |
| 3,881,724 | A | * | 5/1975 | Beveridge | 473/472 |
| 4,407,045 | A | | 10/1983 | Boothe | |
| 4,946,163 | A | * | 8/1990 | Aakre et al. | 473/483 |
| 5,098,092 | A | * | 3/1992 | Aakre et al. | 473/483 |
| 5,100,132 | A | | 3/1992 | Anderson et al. | |
| 5,255,909 | A | | 10/1993 | Wendell | |
| 5,628,508 | A | | 5/1997 | Koole | |
| 5,730,668 | A | | 3/1998 | Hege et al. | |
| 5,772,167 | A | | 6/1998 | Koole | |
| 5,800,294 | A | | 9/1998 | Naecker, Jr. | |
| 5,902,197 | A | | 5/1999 | Davis et al. | |
| 5,913,778 | A | * | 6/1999 | Hying et al. | 52/40 |
| 5,947,847 | A | | 9/1999 | van Nimwegen et al. | |
| 5,983,602 | A | | 11/1999 | Allen et al. | |
| 6,019,690 | A | * | 2/2000 | Parr et al. | 473/481 |
| 6,711,780 | B2 | | 3/2004 | Lee | |
| 6,783,472 | B1 | | 8/2004 | Stanford et al. | |
| 6,866,596 | B2 | | 3/2005 | Steed et al. | |
| 6,881,163 | B2 | | 4/2005 | Schroeder et al. | |
| 7,320,652 | B2 | | 1/2008 | Kilpatrick | |
| 2004/0157688 | A1 | | 8/2004 | Schroeder et al. | |

* cited by examiner

*Primary Examiner*—Gene Kim
*Assistant Examiner*—M Chambers
(74) *Attorney, Agent, or Firm*—Alfred M. Walker

(57) ABSTRACT

A self-storing basketball goal system includes a foundation box enclosing a portable basketball goal including a backboard and hoop rim. The backboard attaches to the distal end section of a post assembly, which is preferably foldable and telescopic. The foundation box may be dug in the ground so that the post and goal assembly is installed upon a top cover of the foundation box which is flush with the ground, or the foundation box may be a remote storage container away from the playing surface. In that case, the post assembly and supporting struts are attached to keyways installed within the playing surface, such as a driveway, patio or other playing surface. The post assembly may then fold into the foundation box with the backboard and removable hoop rim.

24 Claims, 8 Drawing Sheets

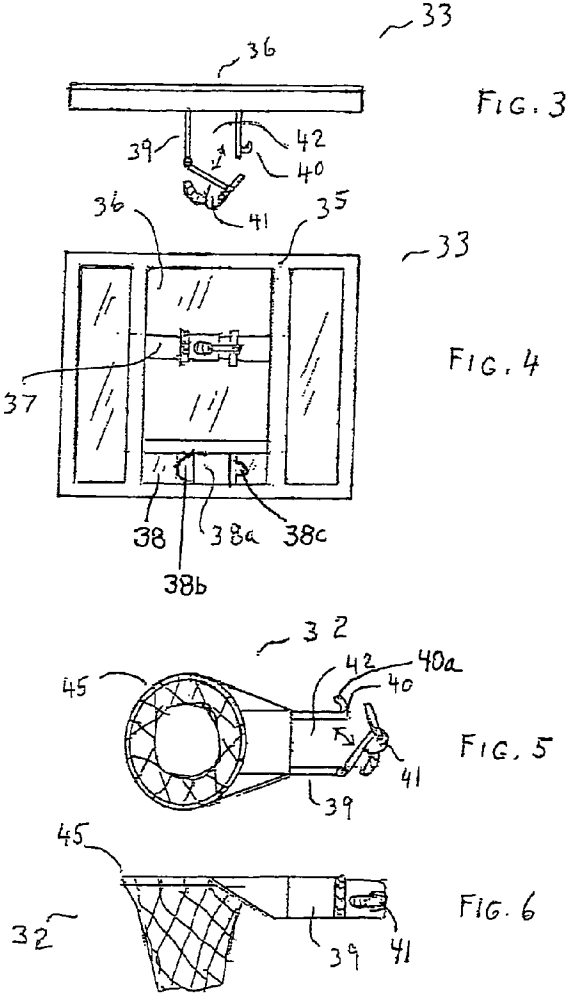
FIG. 3
FIG. 4
FIG. 5
FIG. 6
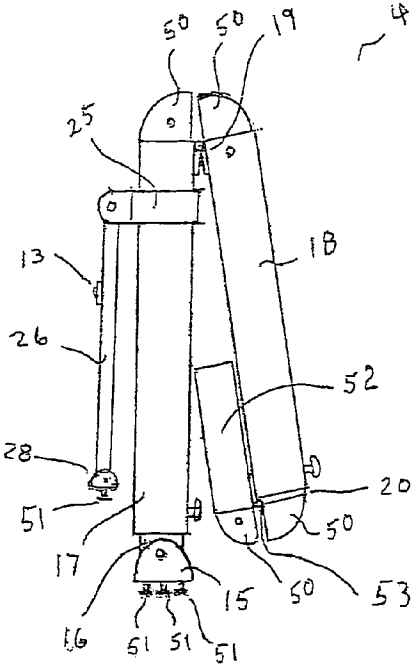
FIG. 2

SELF-STORING BASKETBALL GOAL SYSTEM

FIELD OF THE INVENTION

The present invention relates to convenient, user operable, self-storing basketball goal systems.

BACKGROUND OF THE INVENTION

Basketball goals in residential areas are often an eyesore, especially after a few years of weather deterioration. In some neighborhoods, local ordinances have restricted the location of such devices or have outright banned permanent erection of basketball goals. To attempt to answer the perceived need, the prior art reveals several inventions relating to portable basketball goals.

Most existing basketball systems are semi-permanent when assembled, or are only partially diassembleable. Such systems include, as examples, US Patent Publication No. 2004/0157688 of Schroeder et al, U.S. Pat. No. 5,100,132 of Anderson, U.S. Pat. No. 5,255,909 of Wendell, U.S. Pat. No. 5,628,508 of Koole, U.S. Pat. No. 5,730,668 of Hege et al, U.S. Pat. No. 5,772,167, also of Koole, U.S. Pat. No. 5,800,294 of Naecker, Jr., U.S. Pat. No. 5,902,197 of Davis et al, U.S. Pat. No. 5,947,847 of van Nimwegen et al, U.S. Pat. No. 5,983,602 of Allen et al, U.S. Pat. No. 6,783,472 B1 of Stanford et al, U.S. Pat. No. 6,866,696 B2 of Steed et al and U.S. Pat. No. 6,881,163 B2 of Schroeder et al.

One basketball backboard and net set (U.S. Pat. No. 3,716,234 of Lancelotti) is disassembleable into a box, but all the parts have to be taken apart by loosening rigid nuts and bolts, which of curse are subject to strength requirements for removal and become tighter as time goes on due to the effects of outdoor weather.

None offer the combined features of self-storage at the playing site, high goal stability with desirable offset between post and backboard, and ease of erection or disassembly without the use of tools.

OBJECTS OF THE INVENTION

It is therefore an object of the present invention to provide a convenient, user operable, self-storing basketball goal system.

Other objects which become apparent from the following description of the present invention.

SUMMARY OF THE INVENTION

In keeping with these objects and others which may become apparent, the self-storing basketball goal system of this invention provides a watertight storage compartment in a foundation box. The foundation box is preferably installed within the ground so that the post assembly attaches to a top cover thereof flush with the ground. However, alternatively, it can be a remote storage container where the post assembly attaches to one or more keyways in the playing surface, such as a gymnasium floor, a driveway or a patio. When the foundation box is installed within the ground, it is accessible via a lid that is flush mounted with the ground surface. When not in use, all three subassemblies (rim, backboard, and post) are stored within the compartment. When in use, the post is assembled and locked to the lid of the storage compartment; the rim and backboard are attached to the post, and the entire task is completed in short time without the use of any tools. The post assembly is very robust, and its cantilever removes the post from the playing area providing safety for aggressive fast play. The goal stability is much higher and not subject to tip, like other portable goals. Existing portable goals are also too heavy and cumbersome to move, and too big to store. The rim height can be easily adjusted to accommodate shorter players. Auxiliary mounting plates can be installed to provide alternate playing areas to receive the goal system remote from its storage area. Three small floor plates with female socket features matching those on the auxiliary mounting plates can be mounted flush on a gym floor at the proper spacing to receive the post assembly of this basketball goal system for portable indoor use in a gym area.

The foundation box with storage compartment is installed in an excavated area below grade, or is a remote storage container. When installed in the ground, this foundation for the goal system is installed without the use of concrete which makes it relatively easy to remove and reinstall in another location. Also, the installation area is not permanently altered, be it lawn area or beach sand. In some types of rocky soil material, it is adequate to just bury the foundation box to achieve sufficient stability. In sandy areas or in lighter soil, a ballast, such as a ballast box, ballast plate or other ballasted retaining area, is first installed and filled with heavy ballast such as rocks. The ballast box is installed and carefully leveled at a depth such that the foundation box which is then bolted to its top rim will have its lid flush with the ground surface. The ballast box has a bottom panel that can be removed during installation. The person performing the excavation can actually stand in a hole below the ballast box through this panel hole to more easily perform the leveling operation. After leveling, the foot hole is back-filled, and the bottom panel is bolted back in place before the ballast is introduced.

The post assembly is articulated and telescoping to fit into a relatively small storage compartment. It is preferably constructed of aluminum square tubing of the order of four inches square. By "tubing" it is noted that while the preferably crossection of the tubing is square, it can have any geometric crossection, such as circular, triangular, rectangular or otherwise.

The main post is foldable and/or telescopic in sections, so that it fits with the backboard and removable hoop rim within the foundation box. The main post is foldable and optionally also telescopic in a plurality of sections, preferably in four sections. A bottom length telescopes into an equal length section which is hinged to a similar upper section with its own telescoping section within; the telescoping upper section is then hinged to a shorter backboard attachment section. The telescoping members are captive within the outer members and preferably telescope freely on internal low friction sleeves (such as Teflon™). All sections of the post assembly are preferably pre-attached; another part is a sleeve which rides on the outer lower section (again with low friction internal sleeve). This sleeve collar carries a plurality of support struts, preferably two struts, which attach to the playing surface, such as to the lid of the storage compartment as does the bottom distal end of the lower telescoping section which attaches first via a rotary motion into a triple keyway. The two struts are preferably locked into the base by straightening a lock, such as a folding locking horizontal strut which action forces the strut bottoms laterally within their straight keyways. Note that the lid of the storage box is sturdily locked shut via a lock, such as a pair of cam locks that are then prevented from opening by interference from the two struts locked into their respective keyways adjacent to the lock handles.

The backboard attaches to the attachment post via a fastener, such as a hinged member on a bracket which is locked around the post via a fastener, such as a toggle latch clamp. The rim attaches to the same post in the same manner via a fastener, such as through a rectangular hole in the bottom center of the backboard surface. The rim also engages the bottom of the backboard, creating a second attachment point for the backboard to the post.

Preferably, fasteners, such as two spring-loaded index pins are attached to the upper surfaces of the two members with telescoping sections within. The bottom-most section is pulled out until its index hole matches up and is locked via the index pin. The upper telescoping section is advanced to the desired length (or all the way for regulation rim height) and the index pin is received into the nearest index hole. These holes are spaced about 3" apart to provide this adjustment. After the telescoping sections are secured via the spring pins, the mast is raised to the operational angle which is preferably approximately 60 degrees from the horizontal, although other structurally sound angles of orientation may be employed. At this point, the collar to which the struts are pivoted is aligned with the lower folding member near its bottom end such that side holes align with through holes in the folding member; a spring pin is inserted through the collar and post member locking them together. Thus the post erection is completed.

The actual assembly sequence of the three subsystems starts with unlatching the cam locks securing the cover of the base storage box; the cover is then opened and the backboard, rim and post assembly are retrieved from the storage compartment. Then the cover is re-closed and securely latched by the cam locks. Now the folded post assembly is attached to the base by inserting the distal end into keyways and applying a clockwise twist action. The support struts are then inserted into their keyways on the base storage box cover. The articulated sections of the post assembly are then unfolded, and the telescoping sections are pulled out of their housing members. At this point, the angle of the post has been reduced to bring the distal end down to about 3.5 feet so the rim and backboard can be mounted. The rim and backboard are then attached via their respective fasteners, such as toggle latch clamps. The post is then raised to its play position and secured by inserting a spring pin through the collar assembly.

Disassembly of the three subsystems is started by lowering the post to the low intermediate position by removing the spring pin from the collar. Then the rim and backboard are detached. Once the post is lowered, the rim and backboard are detached by releasing their respective fasteners, such as one or more toggle latch clamps. Then the telescoping sections are pushed into their housing members and articulated sections are folded. The support struts are released from the base. Now the post assemble is released from the base by a counterclockwise twist and lift action. At this point, the backboard, rim and post assembly are placed in the base storage box and secured via cam locks. The two normal hinges and adjacent locking spring pins which are used with the articulated sections can be replaced with adjustable locking hinges of the type often used with adjustable high-end ladders. These are easily operated by pulling a handle or pushing a knob against spring resistance; they are more convenient and eliminate the separate spring pin parts.

In an alternate embodiment of this self-storing portable basketball goal, a different configuration with all components pre-attached to the inside of the lid of the watertight storage compartment is described. The post is in a ladder configuration with preferably two parallel structural members which are pre-attached to the backboard at their distal end. Single structural members can also be used. In operation, the lid of the storage compartment is opened vertically to 90 degrees and locked in place with one or more locking struts, preferably two locking struts. The two folding struts which are straightened into an oblique angle and locked. Attached to the lid are one or more, preferably two parallel post members which are preferable aluminum square tubing, although other tubing crossections may be employed. Each preferably has an equal length telescoping member within which is withdrawn to a desired height (after the other distal members are adjusted) and locked in place by a fastener, such as a spring pin which is inserted through a hole near the top end of the members attached to the lid and also through one of a line of holes in the telescoping members. The telescoping members are attached together by a horizontal shaft near their top distal ends. An articulated member is also hinged at this site on each side. These are swung over the top of the telescoping members and locked into a single prescribed position of about an angle of 48 degrees to the horizontal via spring pins adjacent to the hinges. The distal ends of these parallel angled members are themselves similarly preferably attached together by a horizontal shaft and pivoted to the backboard structural members via fasteners, such as hinges and spring pins. Although a unitary backboard can be used, for space saving storage, preferably the backboard has two folding wings, one at each side that must be opened and locked in the open position prior to play. The rim is hinged and is swung down and locked into position at a right angle to the backboard.

BRIEF DESCRIPTION OF THE DRAWINGS

The present invention can best be understood in connection with the accompanying drawings. It is noted that the invention is not limited to the precise embodiments shown in drawings, in which:

FIG. 2 is a side view of the post assembly as folded into a configuration which fits in the storage box;

FIG. 3 is a top view of the backboard assembly showing the toggle latch clamp locking configuration;

FIG. 4 is a back view of the backboard;

FIG. 5 is a top view of the rim assembly showing the toggle latch clamp attachment configuration;

FIG. 6 is a side view of the rim assembly;

DETAILED DESCRIPTION OF THE INVENTION

Figure 1:
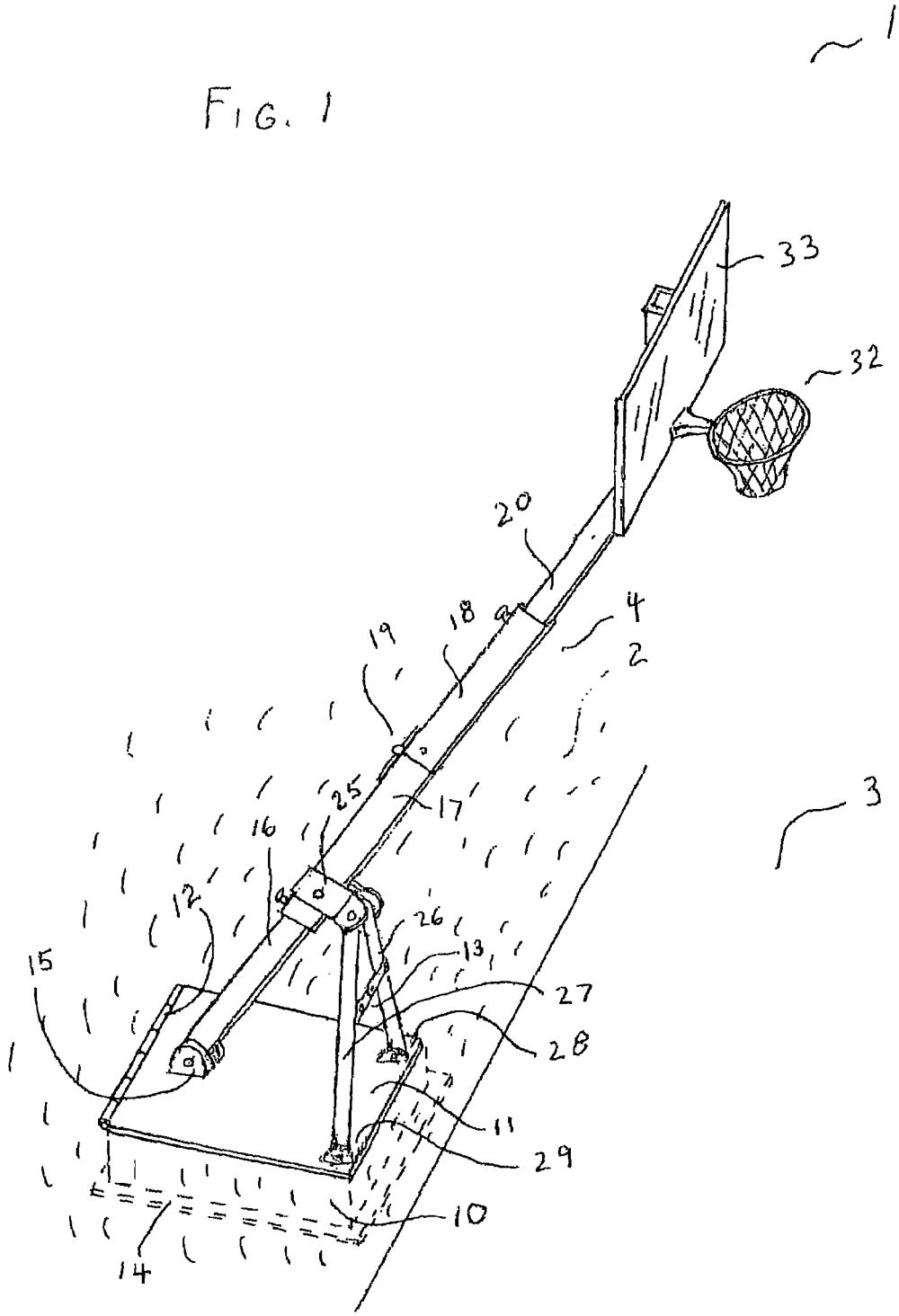
FIG. 1 is a perspective view of the self-storing portable basketball goal of this invention as erected and ready for use.
Figure 11:
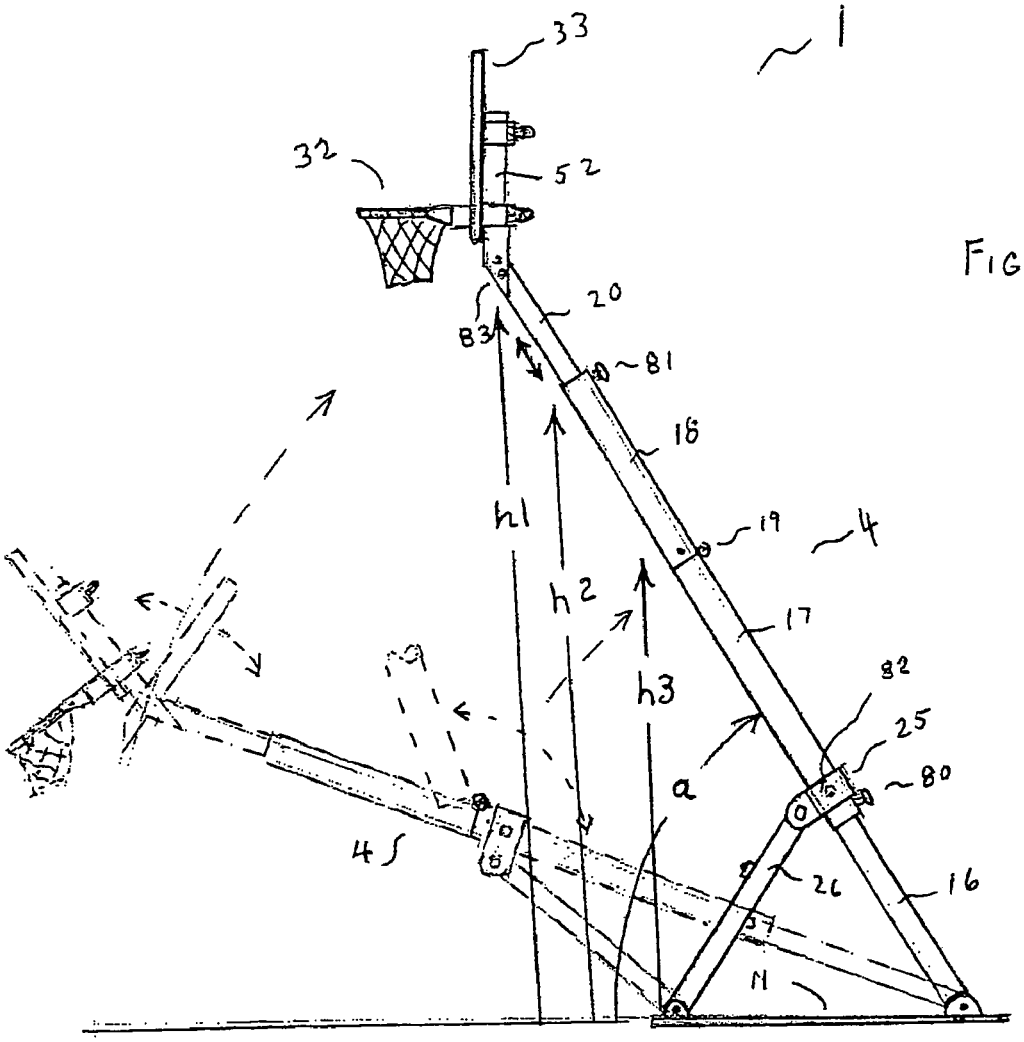
FIG. 11 is a side view of the basketball goal erected with an intermediate low position shown in dashed lines.

FIG. 1 shows basketball goal 1 erected and ready for play. Area 3 is the playing area, while region 2 can be an adjacent lawn or sand or soil area. Post assembly 4 (as shown in FIGS. 1, 2, and 11) includes of various components that are all attached together. It folds and telescopes into the compact configuration shown in FIG. 2 for storage in the watertight storage compartment of foundation box 10.

As shown in FIG. 2, post assembly 4 includes base pivot 15, captive bottom telescoping section 16, bottom main tube 17, upper main tube 18, captive upper telescoping tube 20, backboard attachment tube 52, and strut collar 25 with struts 26 and 27 and strut base pivots 28 and 29.

Low friction sleeves are used within tubes 17 and 18 to facilitate easy travel of captive telescoping sections 16 and 20 respectively. The low friction sleeves are sized to come together to block over travel of the telescoping members 16,17 and 18,20.

Lid 11 is hinged to box 10 by hinge 12; it has keyways under base pivot 15 and under strut pivots 28 and 29. Folding horizontal strut 13 is pivoted on struts 26 and 27 keeping them spread apart and engaged with keyways in lid 11 when it is locked in the straight position.

Both backboard 33 and rim 32 are attached to the distal end section of post assembly 4 which is section 52 as shown in FIG. 2. Note that tubing section 52 is hinged via hinge 53 to the distal end of telescoping tube 20.

FIGS. 3 and 4 show backboard 33 with frame 35, face board 36 (preferably polycarbonate), mounting crossbar 37 and lower rim accommodating region 38. The frame 35 and mounting hardware (wall 39, swinging gate with a fastener, such as a toggle latch clamp 41 and wall 40 with clamp hook 40*a*) are preferably aluminum components which can be welded in place. The enclosed area 42 engages post square tubing member 52 in a snug fit when toggle latch clamp 41 is drawn down. FIGS. 5 and 6 show the rim which has mounting features similar to those of backboard 33. The clamp 41 is passed through notched slit 38*b* of lower rim accommodating region 38 and engages the lower section of tube 52. Walls 39 and 40 of the backboard rim mount advance through notched slits 38*b* and 38*c* capturing tongue bar 38*a*, which is flush with the face of backboard frame 35 of backboard 33. Slit 38*b* is notched convexly outward to accommodate the width of clamp 41 pivotably attached to backboard claim wall 39. Likewise, slit 38*c* is also notched convexly outward to accommodate the width of hook 40*a* of backward clamp wall 40.

Figure 8:
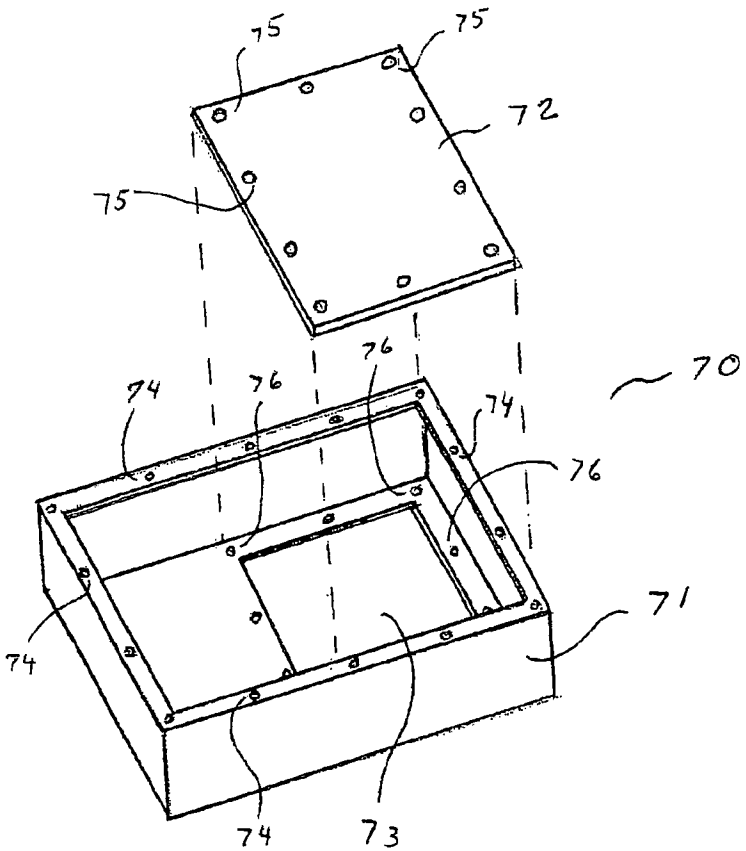
FIG. 8 is a perspective view of the ballast box with removable bottom plate.
Figure 7:
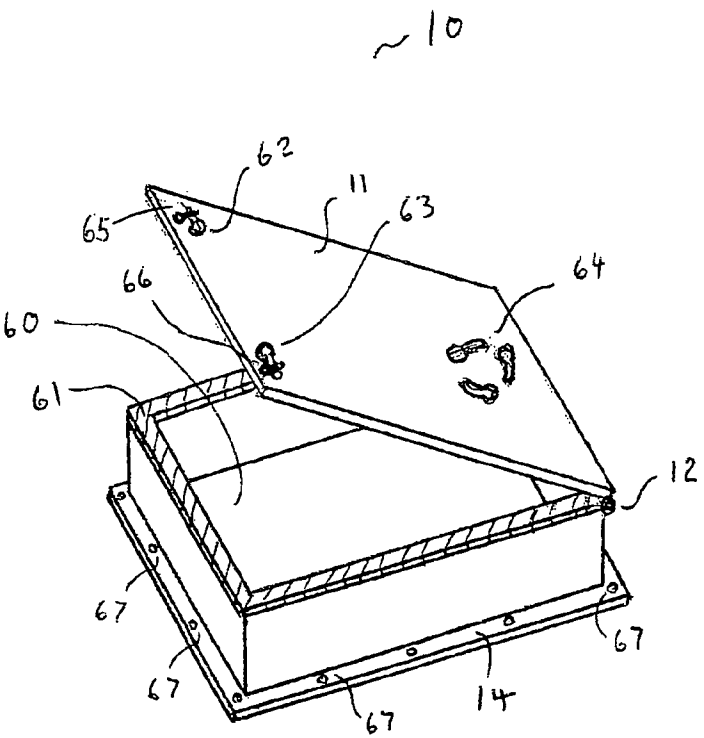
FIG. 7 is a perspective view of the watertight foundation box with lid partially open.
Figure 10:
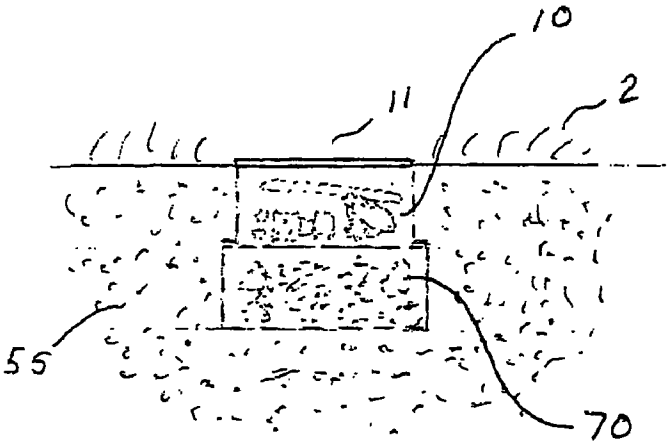
FIG. 10 is a side subterranean view of foundation box with storage compartment attached to the ballast box.
Figure 9:
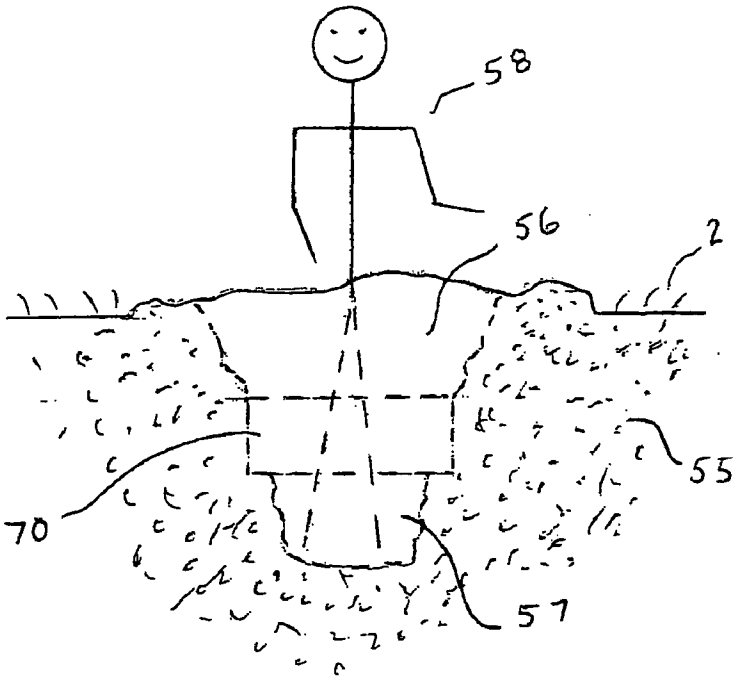
FIG. 9 is a side view of an excavation in progress with ballast box installed and excavator's feet extending below bottom of ballast box through the bottom hatch.

FIG. 7 shows foundation box 10 with watertight storage compartment 60 as sealed by lid 11 against elastomeric gasket 61 under the pressure provided by hinge 12 and cam locks 65 and 66 when in the closed position. Note the circular pattern of three keyways 64. These engage three male key prongs 51 on the bottom of base pivot 15 when prongs 51 are inserted in the enlarged openings and then twisted in a clockwise direction. Front keyways 62 and 63 engage male key prongs 51 on the ends of strut pivots 28 and 29 when they are inserted and then spread apart. Note that as a safety feature, struts 26 and 27 cannot be inserted until the handles of cam locks 65 and 66 are turned out of the interference position; this turning action also engages the cam locks to secure lid 11 in a closed engagement with foundation box 10. Note that the keyway openings in lid 11 are sealed internally with spaced apart covers to prevent water seepage while not blocking the keyways themselves. In some types of substrate, box 10 with the help of rim 14 will provide adequate pull-out resistance to act as a foundation for the basketball goal. However, in softer ground a ballast box 70 as in FIG. 8 is required. This is placed deeper down below foundation box 10 as shown in FIGS. 9 and 10. Ballast box 70 has a hatch opening 73 on its bottom which provides access for the feet of a person during the excavation as shown in FIG. 9. This makes it more convenient to carefully level box 70; 56 is the upper excavation which will accommodate foundation box 10, while lower excavation 57 makes space for the person to be at a lower level. After the leveling is complete, area 57 is backfilled with material 55 and hatch cover 72 is bolted to the bottom using bolts through clearance holes 75 into threaded holes 76. Ballast, such as rocks or broken concrete, can then be introduced into box 70. Then foundation box 10 is attached to the rim of ballast box 70 above side walls 71. Bolts through clearance holes 67 in flange 14 are screwed into threaded holes 74 to accomplish the attachment. Note that box 10 can be inverted and nested within box 70 for shipping purposes.

FIG. 11 shows a side view of goal 1 in the low position for attachment or detachment of backboard and rim (dashed lines), as well as in the deployed position. Note that collar 25 moves from the top of post section 17 to the bottom in making the transition. It is locked via a spring pin 82 when in the deployed position. Index pin 80 locks telescoping section 16 to section 17 at the extended position. Hinge 19, between sections 17 and 18, is locked by an adjacent spring pin. Index pin 81 adjusts the degree of extension of top telescoping member 20 via an array of holes on its top surface (about 31" apart). Height h1 is close to regulation height, while further extension of 20 will take it to its limit, and retraction inward will bring it down to height h2. Spring pin 83 locks in the appropriate angle between distal segment 52 and telescoping section 20 to insure the verticality of backboard 33 as segment 52 is rotated via hinge 53. Telescoping member 16 can be retracted for a further lower height h3, such as six to eight feet above the ground.

Figure 12:
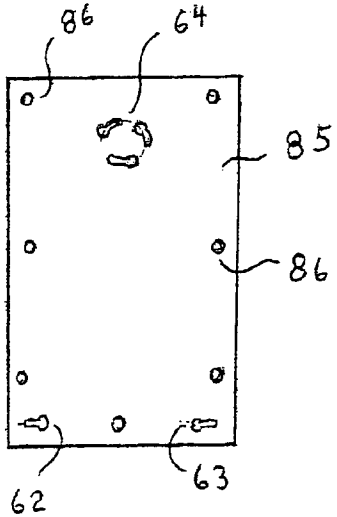
FIG. 12 is a top view of an auxiliary mounting plate showing the female keyways which are used to anchor the post assembly.
Figure 13:
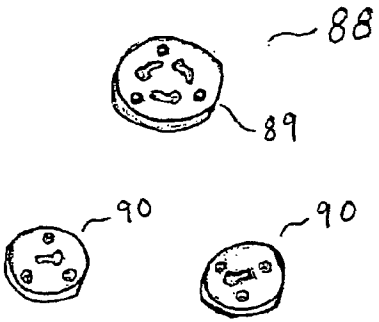
FIG. 13 is a perspective view of a kit consisting of three keyway plates which can be installed flush with a wooden gym floor to permit interior use of the basketball goal of this invention.

FIG. 12 is a top view of an auxiliary mounting plate 85 with pattern of keyways 62, 63 and 64 and straight keyways 62 and 63 at the same relative positions as on foundation box lid 11. This rigid plate can be attached to a rigid in-ground framework or to a series of stakes via screw holes 86 at a location remote from the in-ground storage compartment. FIG. 13 shows a kit 88 including one three-keyway plate 89 and two identical straight keyway plates 90. These can be easily installed so that their upper surface is flush with the floor level inside a gym. If the floor is wood, round depressions can be routed at the appropriate spacings and plates 89 and 90 are then simply screwed down with flat heat screws in the countersink clearance holes in the plates. This would permit use of the portable goal of this invention in an interior space.

While FIG. 12 shows keyways 62 flush with plate 85, in a further embodiment, plate 85 can be recessed within the ground, acting as a ballast, whereby keyways 62, 63 and 64 are elevated by structural tower posts (not shown) to be flush with the ground playing surface area.

Figure 14:
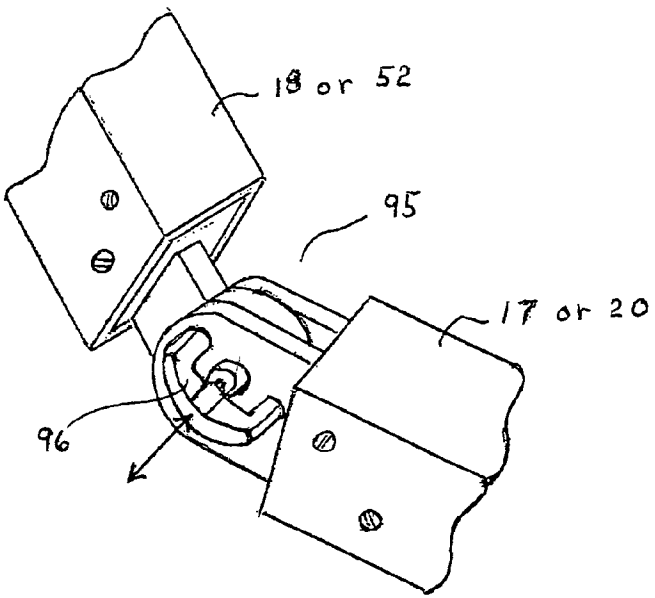
FIG. 14 is a perspective detail of an adjustable locking hinge which can be used with this invention.

FIG. 14 shows a heavy duty adjustable hinge 95 that can be substituted for hinges 19 and 53 (and their adjacent spring pins). This particular design is operated by pulling out handle 96 until it clicks open to release the hinge. By rotating the members to the desired position and clicking it back in under spring force, the hinge would be locked in the alternate position. The design illustrated is an invention of Boothe (U.S. Pat. No. 4,407,045). A similar push button operated adjustable locking hinge can also be used; an example is the invention of Lee (U.S. Pat. No. 6,711,780).

It is further noted that hinges 19 and 53 are on the rearward side of post assembly 4, so that if a structural member or fastener fails, the backboard 33 will only fall rearward, away from the playing area.

Figure 15:
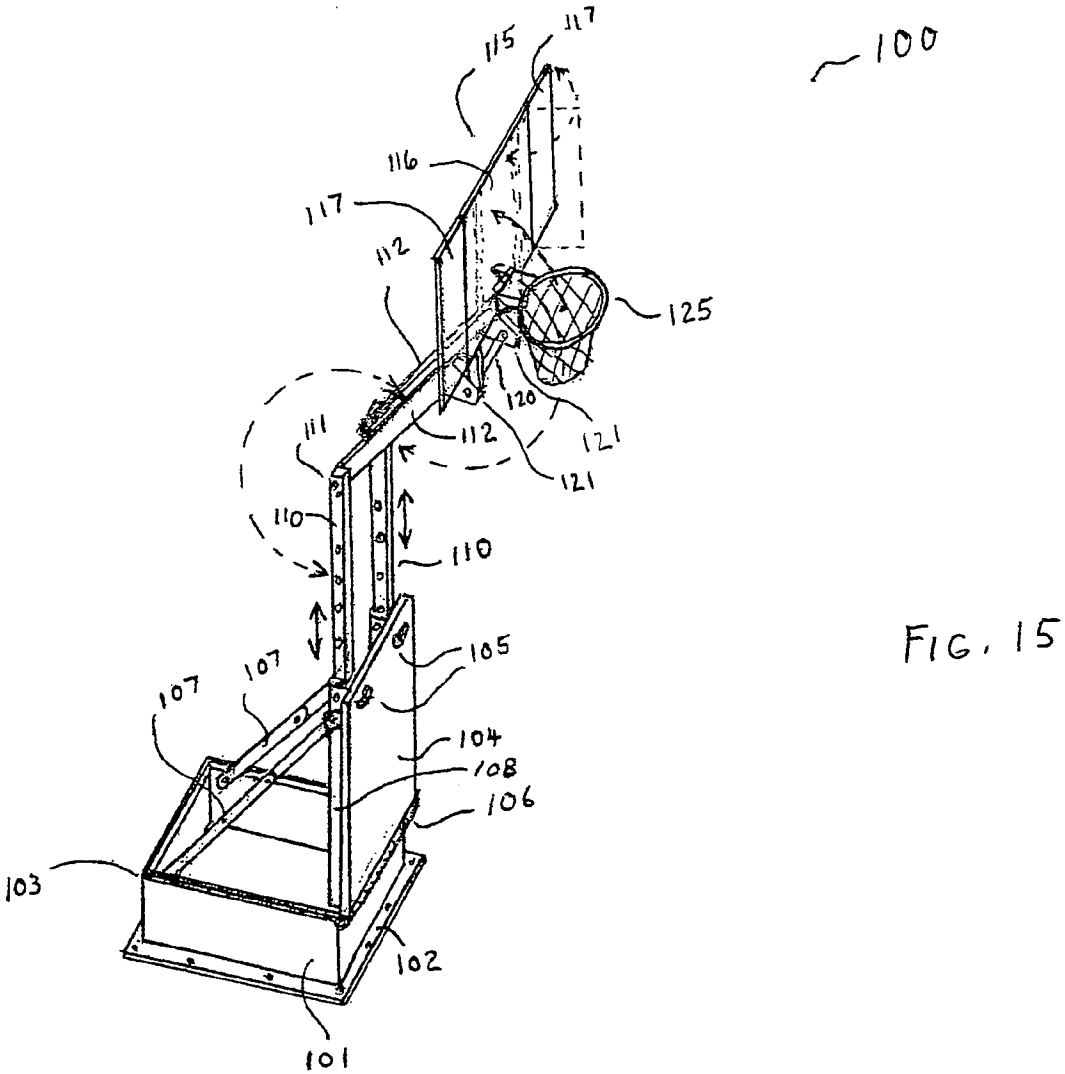
FIG. 15 is a perspective view of an alternate embodiment of the self-storing basketball goal wherein all components are pre-attached to the lid of the watertight storage compartment.
Figure 16:
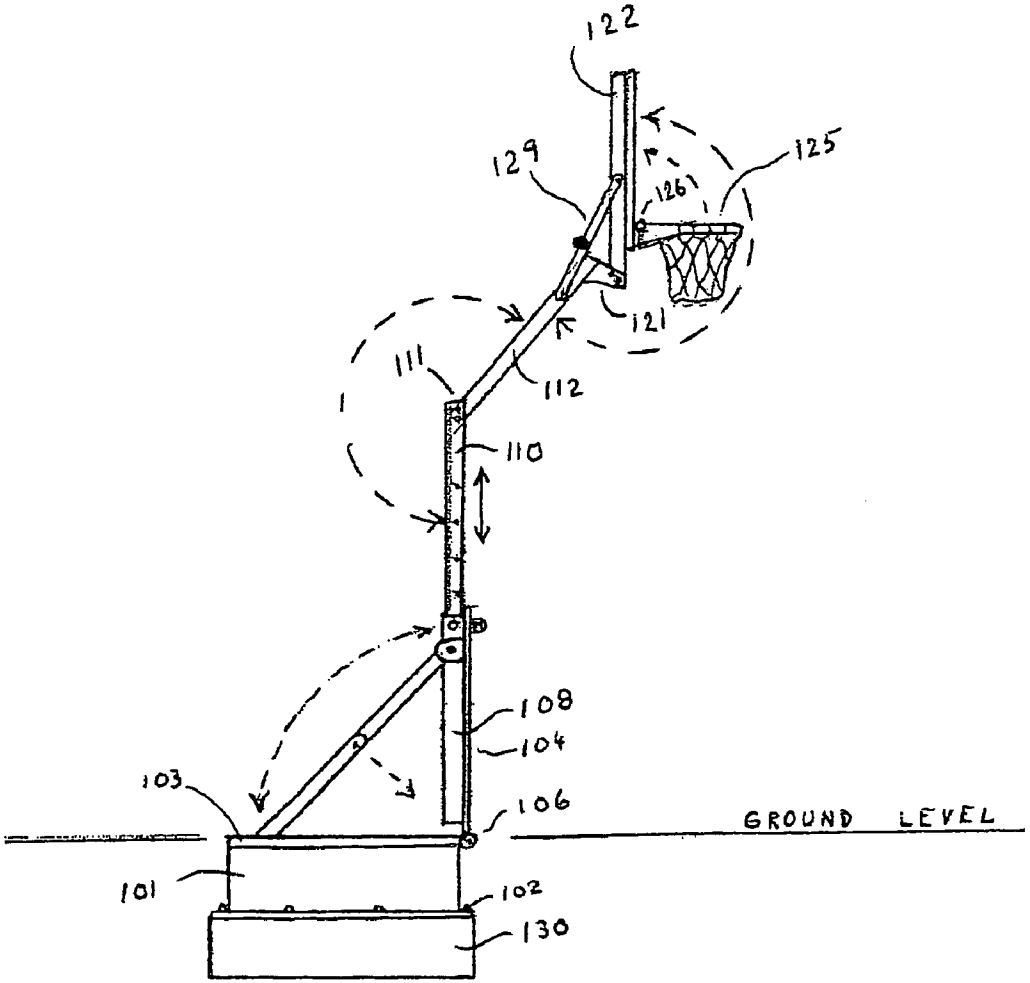
FIG. 16 is a side view of the alternate embodiment of FIG. 15 showing the details of the telescoping and articulated sections.

An alternate embodiment of this invention is shown in FIGS. 15 and 16. In this embodiment, all components are pre-attached; and fold and telescope such that they fit within a storage compartment in watertight foundation box 101 which may be attached to ballast box 130 via bolts through flange 102. Lid 104 is the main attachment for the dual parallel posts that ultimately bear the weight of the other support elements as well as backboard 115 with folding rim 125 which is attached via hinge 126. In the locked position, lid 104 is kept tightly closed via cam locks 105, hinge 106 and gasket 103. In the open position, two folding locking struts 107, pivoted at one end at the inner sides of box 101 and at the distal end at lid 104, are used to position lid 104 at a right angle to box 101. Two square tubing sections 108 are attached to lid 104. Telescoping sections 110 emanate from them with an array of holes which are used to set the desired rim height by using a spring pin through a single hole neat the top end of sections 108 (an index pin can also be used). Two parallel post members 112 are swung around on hinges 111 and locked at a preferable angle of 48 degrees (to the horizontal) using adjacent spring pins. Backboard 115 attached to support posts 122 is swung from the front side of members 112 into the deployed position via hinges 121 at each end of rod 120 and locked in the vertical position using adjacent spring pins and/or rigid strut 129. To permit backboard 115 to fit into a smaller storage compartment, it has a central section 116 attached to support posts 122. On each side of 116 are wing sections 117 which are hinged to 116 and are rotated parallel to 116 and locked in place with latches prior to use. FIG. 16 shows the motion of the various sections during the deployment or take-down operations (using dashed lines with arrow heads).

The alternate embodiment can be erected or taken down conveniently and quickly. The operation can be streamlined by replacing hinges 121 (and their adjacent spring pins) with two adjustable locking hinges such as are shown in FIG. 14.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A portable self-storing basketball goal system comprising:

i) a post assembly having a top end and a bottom end;

ii) a backboard removably mounted on said top end of said post assembly, said backboard having a removable hoop;

iii) the bottom end of said post assembly pivotally and removably mounted to a playing surface;

iv) a slidable strut collar mounted on said post assembly;

v) a pair of struts extending from said strut collar, said struts having free ends pivotally and removably mounted on said top cover;

vi) said post assembly having telescoping sections and being hinged at one or more locations along a rear of said post assembly, allowing said post assembly to be telescoped and folded down to fit into a storage container along with said backboard and hoop for storage;

vii) a bottom end of said post assembly and the free ends of said struts being fitted with keys, and a set of matching keyways allowing said post assembly and struts to be readily engaged and disengaged with said key ways, to mount or dismount said portable basketball goal on or from said top cover;

viii) said set of keys also alternatively mountable in matching keyway plates of an alternate playing surface, and, ix) said post assembly storable within a storage container when not in use; said storage container comprising: a) a foundation box mounted in the ground with a pivoted top cover flush with the surface of the ground.

2. The self-storing basketball goal system as in claim 1 wherein said storage container is insertable within the ground.

3. The self-storing basketball goal system as in claim 2 wherein said storage container includes a watertight inner storage compartment sealed by a lid against an elastomeric gasket under the pressure provided by a hinge and at least one respective lock when in the closed position.

4. The self-storing basketball goal system as in claim 3 wherein said keyway locks each include a keyway plate installed into recesses within said playing surface so that each respective upper surface is flush with said keyway plate.

5. The self-storing basketball goal system as in claim 3 wherein said base pivot and said struts cannot be inserted until respective handles of said cam locks are turned out of an interference position.

6. The self-storing basketball goal system as in claim 2 wherein said storage container is attached to a ballast stabilizing said storage container within the ground.

7. The self-storing basketball goal system as in claim 1 wherein said post assembly is deployed when a collar moves from a top of said main hollow tube to a bottom thereof, said collar lockable in the deployed position;

said telescoping section deployable to a fixed extended position with said main tube, a hinge being provided on a rear side of said post assembly between said main tube and said telescopic section, said hinge being lockable by a pin, an index pin adjusting a degree of extension of said top telescoping member via an array of holes on its top surface, wherein when said rim is close to a position of regulation height, wherein further extension of upper telescopic tube advances said rim upward above said position of regulation height and retraction of said upper telescopic tube reduces said rim below said position of regulation height.

8. The self-storing basketball goal system as in claim 7 wherein said a further locking pin locks said backboard distal attachment segment of said post assembly and said upper telescoping section of said post assembly in a predetermined appropriate angle located between said backboard distal segment and said upper telescoping section of said post assembly, to insure the verticality of said backboard, as said backboard distal attachment segment is rotated via a hinge.

9. The portable basketball goal as in claim 7 wherein said hinge has a central axis and a locking handle which moves axially between an unlocked position and a locked position under spring force thereby permitting said attached members to be locked in two alternate positions and to be freely rotated between them.

10. The self-storing basketball goal system of claim 1 having a ballast underground, said ballast positioned below and attached to said foundation box, said ballast being filled with heavy materials including at least one of rocks and/or concrete.

11. The self-storing basketball goal system as in claim 1 wherein respective low friction over-travel limiting sleeves are provided within said respective hollow upper and lower tubes, thereby facilitating smooth travel of said captive telescoping sections, respectively.

12. The portable basketball goal as in claim 1 wherein backboard distal attachment section is foldable against said upper main tube by a hinge between said backboard attachment tube and said upper telescoping tube, said hinge having a central axis and locking handle which moves axially between an unlocked position and a locked position under spring force thereby permitting said attached tubes to be locked in two alternate positions and to be freely rotated between them.

13. The self-storing basketball goal system as in claim 1 wherein a pivot is twistably locked into a respective key way.

14. The self-storing basketball goal system as in claim 1 wherein a game playing surface is an upper cover of said storage container.

15. The self-storing basketball goal system as in claim 1 wherein a game playing surface is a driveway surface.

16. The self-storing basketball goal system as in claim 1 wherein a game playing surface is a patio surface.

17. The self-storing basketball goal system as in claim 1 wherein a game playing surface is an indoor playing surface.

18. The self-storing basketball goal system as in claim 1 wherein said backboard includes a frame having a clamp engageable with said hoop rim.

19. The method of storing and deploying the device of claim 1 comprising the steps of:

a) planting in the ground a foundation box having a pivoted top cover exposed at ground level, said cover secured to said foundation box with cam locks, said foundation box containing a folded portable basketball game;
b) opening said cam locks;
c) opening said top cover and removing said portable basketball game;
d) closing said top cover;
e) locking said top cover with said cam locks;
f) attaching said post assembly to said top cover by a twisting action;
g) attaching support struts to said top cover;
h) unfolding said post assembly;
i) pulling out telescoping sections of said post assembly from their respective housing members;
j) attaching said backboard and said rim to said post assembly;
k) raising said post assembly to a playing position;
l) locking said post assembly to said playing position by inserting a spring pin through collar, thereby completing deployment of said basketball game, using said foundation box as a base.

20. The method of claim 19 in which said portable game is disassembled by the steps wherein said post assembly is folded and then removed from said top cover; wherein said top cover is unlatched and opened, and placing said basketball game within; wherein said top cover is again securely latched, leaving said foundation box for storage in situ, until the next time said portable basketball game is to be deployed and used.

21. The method of claim 20 in which a ballast containing weighted materials is mounted under and attached to said foundation box for providing greater support to said portable basketball game when deployed and in use.

22. A portable selfstoring basketball goal system comprising:

i) a post assembly having a top end and a bottom end;
ii) a backboard removably mounted on said top end of said post assembly, said backboard having a removable hoop;
iii) the bottom end of said post assembly pivotally and removably mounted to a playing surface;
iv) a slidable strut collar mounted on said post assembly;
v) a pair of struts extending from said strut collar, said struts having free ends pivotally and removably mounted on said top cover;
vi) said post assembly having telescoping sections and being hinged at one or more locations along a rear of said post assembly, allowing said post assembly to be telescoped and folded down to fit into a storage container along with said backboard and hoop for storage;
vii) a bottom end of said post assembly and the free ends of said struts being fitted with quick release fasteners, and a set of matching keyways allowing said post assembly and struts to be readily engaged and disengaged with said key ways, to mount or dismount said portable basketball goal on or from said top cover;
viii) said set of quick release fasteners also alternatively mountable in matching receptacles plates of an alternate playing surface, and,
ix) said post assembly storable within said storage container when not in use.

23. A self-storing basketball goal system comprising:

a) a foundation box;
b) a portable basketball goal comprising:
i) a post assembly having a top end and a bottom end;
ii) a backboard removably mounted on said top end of said post assembly, said backboard having a removable hoop;
iii) the bottom end off said post assembly pivotally and removably mounted on a top cover of said foundation box;
iv) a slidable strut collar mounted on said post assembly;
v) a pair of struts extending from said strut collar, said struts having free ends pivotally and removably mounted by quick release fasteners on a playing surface; and in which the bottom end of said post assembly and the free ends of said struts are fitted with said quick release fasteners, and said top cover is fitted with matching receptacles, allowing said post assembly and struts to be readily engaged and disengaged with said quick release fasteners, to mount or dismount said portable basketball goal on or from said top cover,
vi) said post assembly having telescoping sections and hinged at one or more locations along said post assembly, said sections allowing said post assembly to be telescoped and folded down to fit into said foundation box along with said backboard hoop for storage.

24. The self storing basketball goal system of claim 23 in which said foundation box is mounted in the ground with said top cover flush with the surface of the ground, thereby allowing storage of said system in situ.

* * * * *